US006330901B1

(12) United States Patent
Friesen et al.

(10) Patent No.: US 6,330,901 B1
(45) Date of Patent: Dec. 18, 2001

(54) Z-SHAPED STRUT FOR DOOR PANEL

(75) Inventors: Raymond J. Friesen, Mississauga; Leonid Ostrovsky, Thornhill, both of (CA)

(73) Assignee: Raynor Canada Inc., Mississauga (CA)

( * ) Notice: Subject to any disclaimer, the term of this patent is extended or adjusted under 35 U.S.C. 154(b) by 0 days.

(21) Appl. No.: 09/449,770

(22) Filed: Nov. 26, 1999

(30) Foreign Application Priority Data

Nov. 27, 1998 (CA) ..... 2255088

(51) Int. Cl.[7] ..... E05D 15/06

(52) U.S. Cl. ..... 160/201; 160/229.1; 160/232; 49/383

(58) Field of Search ..... 160/201, 229.1, 160/232, 40; 16/224, 251, 225; 49/383

(56) References Cited

U.S. PATENT DOCUMENTS

| | | | | |
|---|---|---|---|---|
| 3,941,180 | | 3/1976 | Thill | 160/229 |
| 3,967,671 | | 7/1976 | Stanley et al. | 160/232 |
| 4,205,713 | * | 6/1980 | Galbreath | 160/201 |
| 4,644,725 | | 2/1987 | Schijf | 52/463 |
| 4,893,666 | | 1/1990 | Hörmann | 160/229.1 |
| 4,934,439 | * | 6/1990 | Martin | 160/201 |
| 5,002,114 | | 3/1991 | Hörmann | 160/229.1 |
| 5,129,441 | | 7/1992 | Leist et al. | 160/229.1 |
| 5,148,850 | | 9/1992 | Urbanick | 160/231.1 |
| 5,170,832 | | 12/1992 | Wagner | 160/201 |
| 5,235,724 | * | 8/1993 | Parrin et al. | 160/201 X |
| 5,359,812 | | 11/1994 | Mayfield | 49/383 |
| 5,509,457 | * | 4/1996 | Jella | 160/201 |
| 5,566,740 | * | 10/1996 | Mullet et al. | 160/229.1 |
| 5,630,459 | * | 5/1997 | Martin | 160/236 |
| 5,706,877 | * | 1/1998 | Grisham et al. | 160/201 |
| 5,749,407 | * | 5/1998 | Brenner et al. | 160/201 X |
| 5,884,363 | * | 3/1999 | Tofts | 160/201 X |
| 6,112,799 | * | 9/2000 | Mullet et al. | 160/201 |

FOREIGN PATENT DOCUMENTS 2 117 813 A 3/1983 (GB) .

* cited by examiner

*Primary Examiner*—Bruce A. Lev
(74) *Attorney, Agent, or Firm*—Sim & McBurney

(57) ABSTRACT

A reinforced garage door panel construction comprises a sandwich panel system having inner and outer skins with interconnecting insulating material, a continuous reinforcing strip extending along an inner face of the inner skin and secured to the inner face, a modified "Z" shaped structural member extending substantially the length of the panel and secured to the inner skin at the continuous reinforcing strip by fasteners which extend through the skin and into the continuous reinforcing strip, the modified "Z" shaped structural member having a web with an upstanding front flange and a depending rear flange, the depending rear flange having an inwardly extending lip extending essentially parallel to the web and the depending flange having spaced apart reinforcing beads extending the length of the depending flange.

11 Claims, 9 Drawing Sheets

Z-SHAPED STRUT FOR DOOR PANEL

FIELD OF THE INVENTION

This invention relates t reinforcement struts for use in reinforcing panel sections of interconnected panel partitions such as panel doors and in particular panel garage doors.

BACKGROUND OF THE INVENTION

Sectional panel partitions are commonly used in commercial, industrial and residential applications particularly for use as door closures. In the residential application, the sectional doors are commonly referred to as garage doors. Examples of such sectional doors are described in U.S. Pat. Nos. 3,941,180 and 3,967,671. The doors are made up of individual hingedly interconnected panels which pivot relative to one another as the door is moved from its closed position to its upward out of the way open position. Various types of interconnecting designs for the panels and related hinges are described in U.S. Pat. Nos. 4,644,725, 4,893,666, 5,002,114, 5,129,441, 5,148,850, 5,170,832 and 5,359,812 and U.K. Patent, Publication GB 2117813-A1, published Oct. 19, 1983, entitled "Connecting Wall Panels" in the name of Leonid Ostrovsky.

The concept of sectional portions for a door which may be cut to any width to provide a custom door design is described in the aforementioned U.S. Pat. No. 3,967,671. The basic design for a finger pinch proof interconnection of the panels is described in the aforementioned U.S. Pat. No. 3,941,180.

Due to the popularity of this sectional door design, there is a continuing demand to provide doors of ever increasing width and height. Although the height of the door can be accommodated by using more panels in the door build up, the width of The door is limited to some extent by virtue of its own structural integrity for each door panel. As the door width increases it is understandable that the panels can only withstand certain wind loads before their structural integrity is compromised and the panels begin to bend. In this respect various steps have been taken in the past to reinforce selected panels over the door width by use of appropriate struts. The most common type of strut is the top hat in section that is a C-section having opposing depending flanges which facilitate attachment of the strut to the selected panel. There are of course other shapes for struts which have been used in reinforcing panel doors such as the Z-shaped truss and modified C-shaped truss which accommodates a reinforcing rod at its head portion. The problem with existing strut designs however is that they are not readily installed on the door panel, require extra mounting clips or the like and do not always offer the required reinforcing characteristic to permit manufacture of door widths in excess of twenty-eight feet. These prior types of struts or trusses are mounted to the rear face of door panels by retaining clips; hence, the extent of reinforcement is determined solely by the design of The strut section. Tis type of mounting allows relative movement of the strut relative to panel inner face. It is also understood that depending upon The application, the wind load and deflection requirements will vary. It is therefore important to have a strut or truss section which can be readily adapted for a variety of applications.

In accordance with this invention a strut design is provided which considerably strengthens the door panel. In addition a mounting bracket which is integral with the hinge structure may be used to secure the preferred modified Z-shaped strut or any other type of strut for the door interior to reinforce same. The strut, in accordance with an embodiment of this invention, is of relative reduced weight compared to prior structures for the same wind load and deflection capacity. The struts are more readily installed and become a structural component of the door panel. Regardless of the strut size, they are installed in the same manner to minimize thereby labor error during installation.

SUMMARY OF THE INVENTION

In accordance with an aspect of the invention there is provided a reinforced garage door panel construction comprising:

i) a sandwich panel system having inner and outer skins with interconnecting insulating material, ii) a continuous reinforcing strip extending along an inner face of said inner skin and secured to said inner face, iii) a modified "Z" shaped structural member extending substantially the length of said panel and secured to said inner skin at said continuous reinforcing strip by fasteners which extend through said skin and into said continuous reinforcing strip, iv) said modified "Z" shaped structural member having a web with an upstanding front flange and a depending rear flange, said depending rear flange having an inwardly extending lip extending essentially parallel to said web and said depending flange having spaced apart reinforcing beads extending the length of said depending flange.

In accordance with another aspect of the invention there is provided a hinge structure for interconnecting garage door panels, said hinge comprising:

i) first and second hinge plates interconnected by a pivot, ii) said first hinge plate having an extended structural portion which extends outwardly away from a base portion of said hinge, iii) said extended structural portion comprising a foot which is adapted for attachment to a structural reinforcing member for a garage door panel, iv) said structural portion having a reinforcing bead extending there along towards said foot.

BRIEF DESCRIPTION OF THE DRAWINGS

Preferred embodiments of the invention are shown in the drawing wherein.

DETAILED DESCRIPTION OF THE PREFERRED EMBODIMENTS

Figure 1:
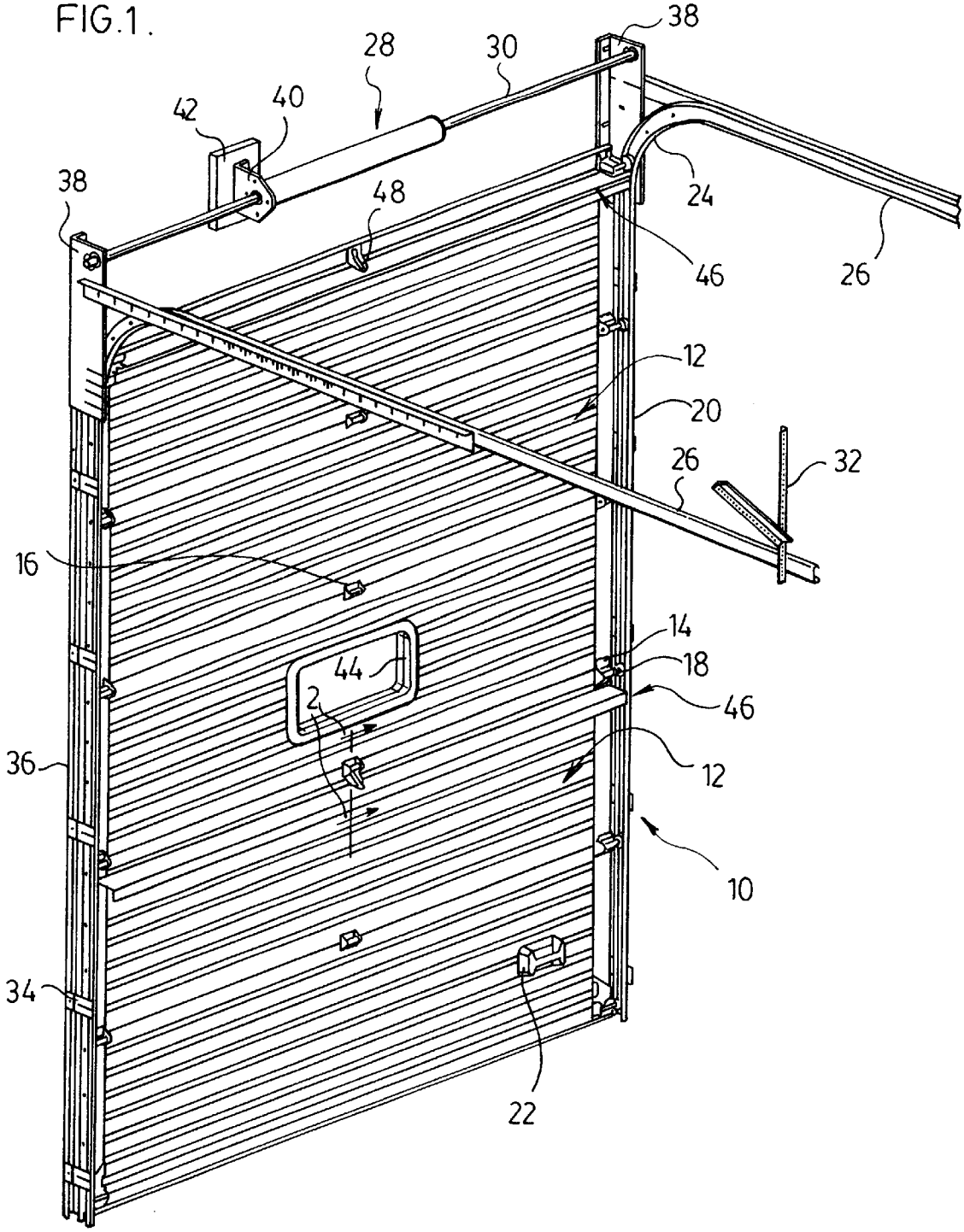
FIG. 1 is a perspective view of he interior of a garage door.

Although preferred embodiments of the invention will be described with respect to standard type of roller door having multiple sections and commonly used in garages, it is understood that the door construction may be used in any type of barrier application whether it be partitioning where the partitioning needs to be removed temporarily or in large building door installations, service garages and the like. With reference to FIG. 1 a standard door construction 10 is shown. The roller door comprises individual panels generally designated 12. The panels are connected to one another by way of roller hinges generally designated 14 and intermediate hinges generally designated 16. The roller hinges 14 have rollers 18 mounted on shafts which extend into standard bores in the hinges. The rollers 18 are mounted in suitable tracks 20 which receive and capture the rollers 18 and guide movement of the rollers as the door is raised. The door may be raised by any convenient door raising mechanism or may be done so manually by grasping the hole 22 on the door interior. As the door is raised the rollers 18 follow the track 20 around arcuate track portion 24 to the horizontal track portion 26 where the door is stored upwardly out of the way. To assist in raising of the door, the usual counter balance in the form of a coiled spring 28 is secured to drive rods 30 which are interconnected to cables not shown for counter balancing the weight of the door to around arcuate track portion 24 to the horizontal track portion 26 where the door is stored upwardly out of the way. To assist in raising of the door, the usual counter balance in the form of a coiled spring 28 is secured to drive rods 30 which are interconnected to cables not shown for counter balancing the weight of the door to facilitate raising from the lowered position. The horizontal track portions 26 are secured to the ceiling or other supporting structure by the usual struts 32. Also in accordance with standard construction, the rails 20 are connected to brackets 34 which in turn are secured to plates 36. These components are secured to the door jams to provide the necessary support. At the top for the counter balancing device, opposing plates 38 are provided which support the drive rods 30. In addition, the counter balancing device may also be connected through plate 40 to wall bracket 42.

The door is shown with the usual window opening 44. It is understood that a variety of decorative window openings may be provided in the door panels 12. Alternatively, the door panels may be cut out to provide an access door through the panel door.

As the width of the door increases the sectional panels 12 require reinforcement. In accordance with this particular embodiment, reinforcing struts 46 are provided at the intermediate height of the door as well as at the top portion of the door. The intermediate strut 46 is secured in a special manner as described with respect to FIG. 2. The upper strut 46 is secured to the top panel of the door by way of angle brackets 48. Although the particular arrangement of struts is for purpose of illustration, the general rule is tat depending on the wind load and deflection requirements, the struts are placed on die top and bottom panels; or on the top, bottom and every second panel; or on the top, bottom and every panel in between.

Figure 2:
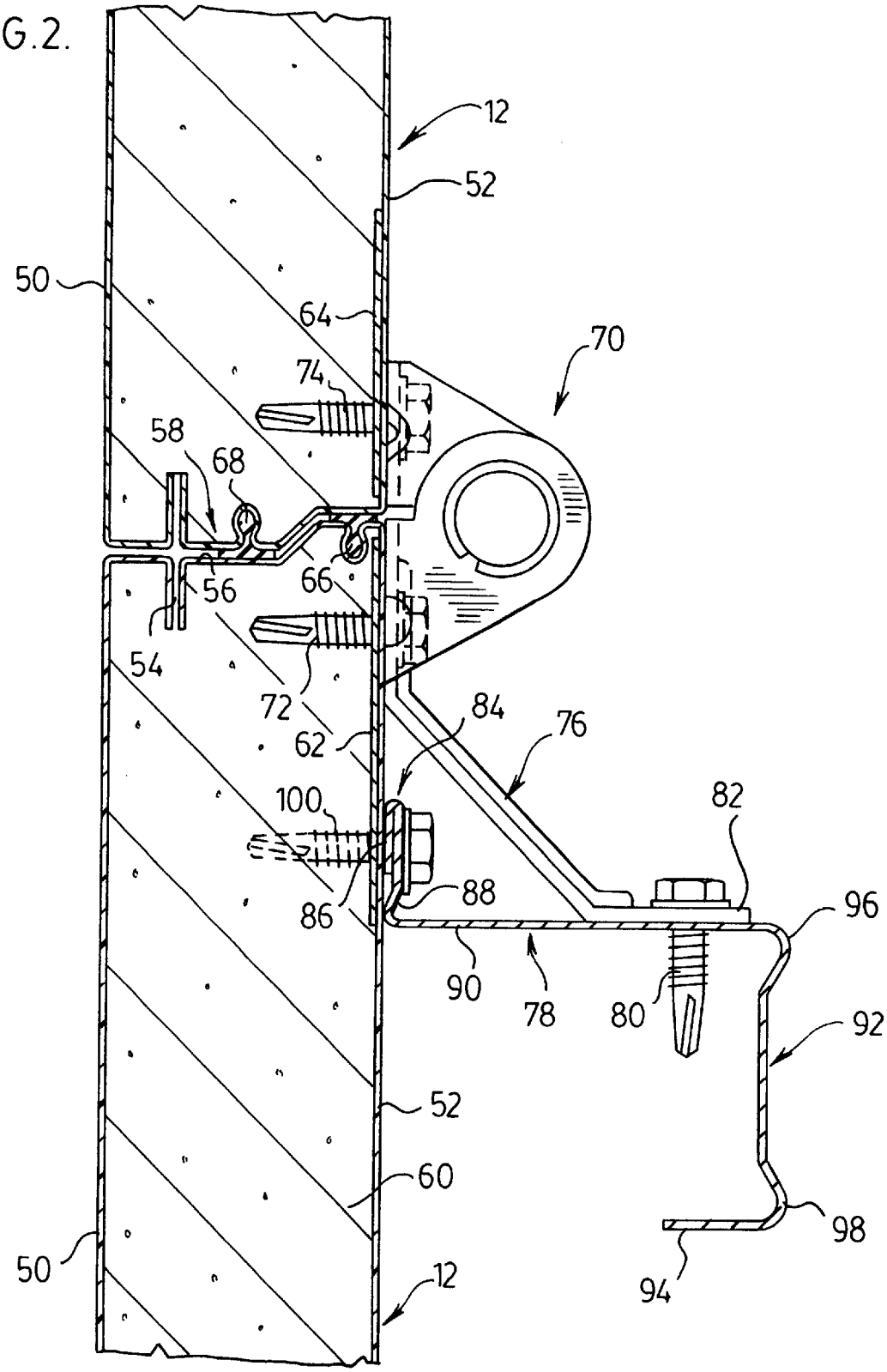
FIG. 2 is a section along the lines 2—2 of FIG. 1.

With reference to FIG. 2 The door panel sections 12 are shown. Each panel section 12 comprises an outer barrier wall 50 and an inner barrier wall 52, The panels 12 may be formed in a continuous manner where the inner and outer walls 50 and 52 are joined at cold break 54 to form the respective sop edge 56 and bottom edge 58. The material interconnecting The inner and outer walls 50 and 52 may be a polyurethane foam 60 which provides both insulative characteristics as well as adhesive characteristics to form a relatively strong yet light weight and highly insulated structure 12. These panels may be provided in extended widths and then cut so as to provide the desired door width. All of the necessary hardware is then mounted on the panels to complete installation. As the panels are formed each panel includes an internal reinforcing strip 62 and 64 at the top and bottom of each panel to provide the necessary reinforcement for attachment devices including fasteners.

In this particular embodiment the top section includes a weather stripping bead of material 66 and the bottom section 58 includes weather stripping bead of material 68. These beads of weather stripping abut the respective opposing surfaces to complete the seal of the door sections when the door is in the closed position.

As is common to the industry a hinge generally designated 70 is secured to the top section 56 in 6 bottom section 58 of adjacent door sectional panels. As shown in FIG. 2 the connection is made by respective fasteners 72 and 74 which pass through the inner walls 52 as well as the respective reinforcing plate 62 and 64 to complete the connection of the hinge to the respective panels. In this particular embodiment the hinge 70 has integrally formed therewith a brace generally designated 76 which extends downwardly from the hinge and is connected to the modified Z-shaped reinforcement strut 78. Such connection is made by way of fasteners 80 extending through an angled flange portion 82 of the brace 76. The modified Z-shaped strut comprises a folded over base flange 84 which has inner flange 86 and outer flange 88. Extending essentially at right angles to the base flange 84 is the web 90. Depending from the web 90 is a depending rear flange generally designated 92 with interiorally directed reinforcing lip 94. The rear flange 92 may have corrugations or reinforcing beads such as at 96 and 98 to increase bending moment of the rear flange and thereby resist buckling of the web 90 when either an external horizontally directed force is applied to either the exterior or interior of die door. The Z-shaped strut is secured to the door interior panel by fastener 100 which also extends through the reinforcing material 62 to complete the connection which is essentially fixed subject to the shear strength of the fasteners. The Z-shaped strut is furthermore held in position by the brace 76 which further resists movement of the web in a vertical direction which as previously noted can be induced by a force applied to the door. The number of hinges 70 with corresponding braces 76 is determined by the door width although the preferred embodiment of FIG. 1 shows a single hinge with brace 76.

The modified shape of the Z strut 78 enhances its structural strength but at the same time considerably reduces the amount of material used in the strut particularly compared to the standard C-shaped or top hat shaped strut. The base flange 84 of the Z-shaped strut has a folded over portion to enhance the strength of the flange as connected at spaced apart intervals (usually two feet) to the wall 52 of the door sectional panel. The web 90 extends out from the interior door face a considerable distance depending upon the extent of reinforcement required.

Preferably, the strut is made in a multiple of web depths so that inventory can be minimized and one need only select from 2 or 3 strut sizes to handle door widths which may vary from about 10 feet to over 45 feet.

The corrugations or beads 96 and 98 in the depending flange 92 greatly enhance the bending moment of the flange and thereby further resist buckling of the web 90 when the door is stressed. The provision of the lip 94 also further increases the bending moment of the flange 92 to further increase the strength of the Z-shaped section. Accordingly the Z-shaped section greatly increases door strength in resisting horizontal forces along The width of the door. By integrating the brace 76 with the hinge, the top section of each door panel is greatly strengthened to enhance bending resistance of each panel. Providing the brace 76 as an integral component of the hinge ensures that the Z-shaped suit is always held in position to enhance bucking resistance. In this respect it is understood that the hinge with integral brace may be used with other strut sections for reinforcing the door panels. For example, the hinge with integral brace could be used in combination with the standard Z-shaped strut or standard C-shaped strut. It is also understood that, by virtue of connecting, bonding, or welding the strut to the door inner panel, it is essentially fixed to form a composite reinforcing structure. Unlike the prior art which allows relative movement, the fixed relationship of the strut to door panel forms a reinforcing section which includes not only the strut, but as well the section of the panel. Hence, this composite structure offers greater bending moment with less weight compared to prior art structures.

Figure 3:
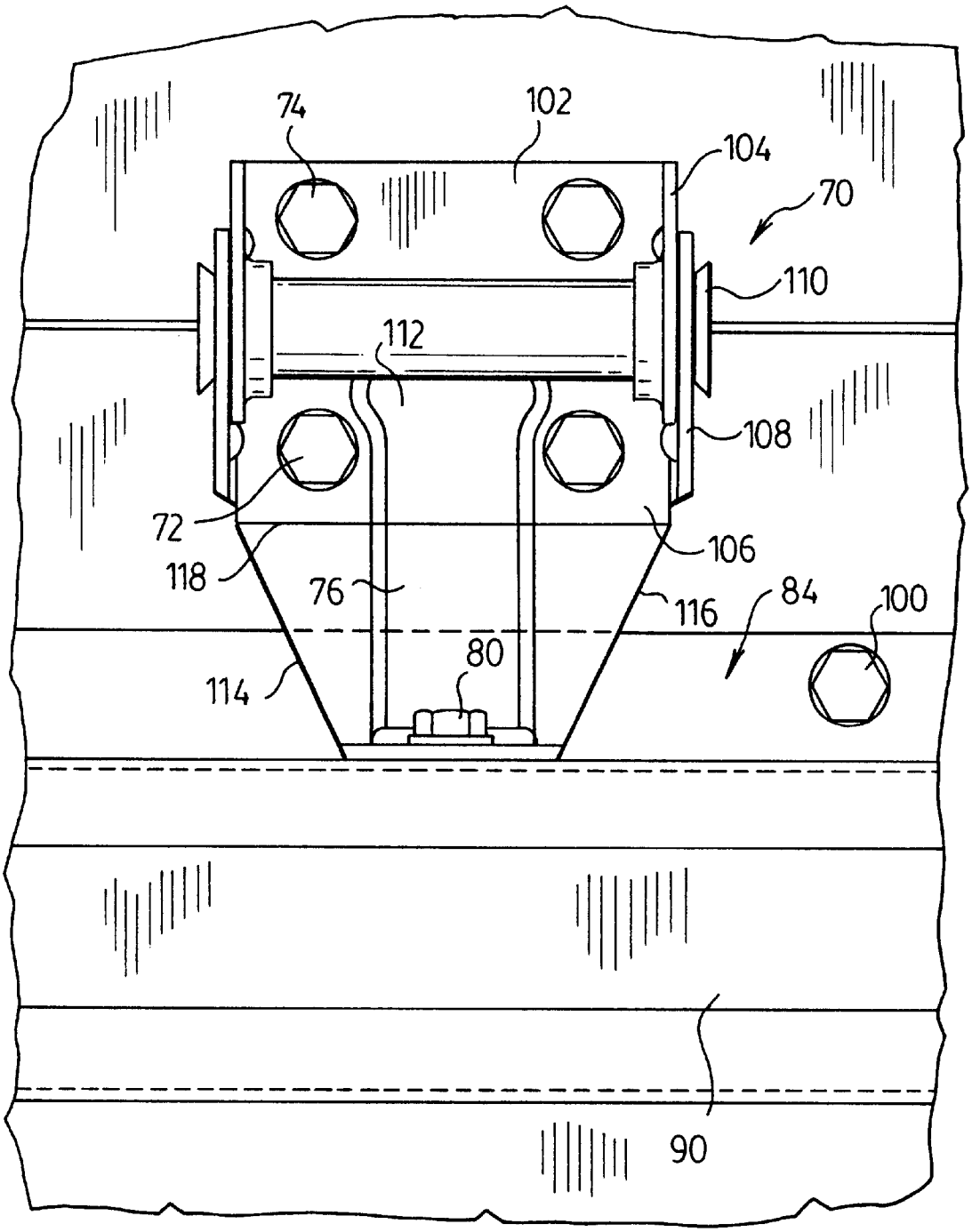
FIG. 3 is a rear elevation view of die door of FIG. 1 showing the preferred hinge structure for bracing the reinforcement strut.

With reference to FIG. 3, further benefits of the hinge design are shown. The hinge 70 has inner hinge plate 102 with depending flanges 104 located within outer hinge plate 106 which in turn has outer hinge flanges 108. A tubular hinge pin 110 interconnects the flanges 104 and 108 to complete the hinge structure.

The tubular pin 110 provides the standard bore which may receive a shaft of a roller 18 used at the door edges, if required. Although, preferably, other hinge structures are used in that respect as will be described in regards to FIGS. 4 through 7. The outer hinge plate 106 includes the brace 76 integrally attached at 112 and extends rearwardly with tapered sides 114 and 116. The brace is bent outwardly from the hinge plate 106 at break line 118.

Figure 4:
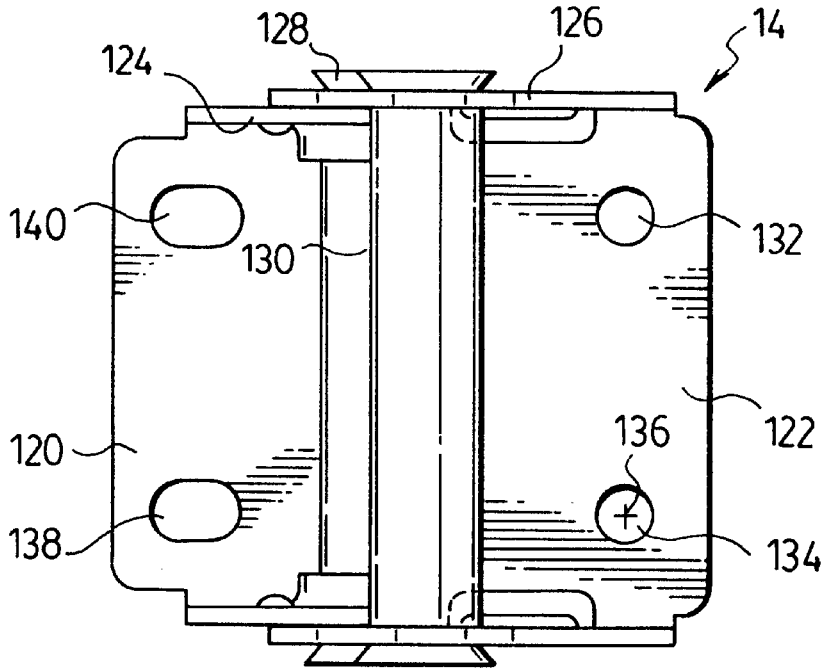
FIG. 4 is a plan view of the modified hinge design.
Figure 5:
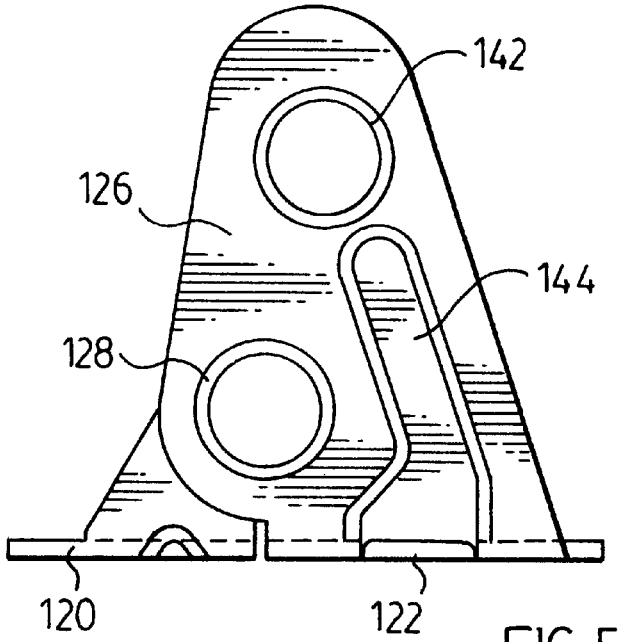
FIG. 5 is a side elevation view of the hinge of FIG. 4.

A typical roller hinge 14 is shown in FIG. 4. The binge comprises inner hinge plate 120 and outer hinge plate 122 where the inner flanges 124 are positioned within the outer flanges 126 and interconnected by tubular hinge pin 128. The significant benefit for the design of the hinge of FIG. 4 is that each hinge plate 120 and 122 has the apertures for the fasteners located laterally of one another and in the orientation of the hinge axes 130. The fastener holes 132 and 134 in accordance with this particular embodiment have centres 136 parallel with the binge axes 130. Correspondingly the apertures 138 and 140 are also aligned with the hinge axes where the apertures 138 and 140 are elongate to provide for slight adjustment in the hinge orientation during installation. This structure is superior to the prior art structures where the fastener apertures were aligned and extended transversely or at right angles to the hinge axes. By locating the fastener openings laterally of one another and parallel to the hinge axes, greater strength is achieved in the hinge connection particularly with the provision of the fastener reinforcing strips 62 and 64 at the top and bottom of each panel. As shown in FIG. 5 in addition to the tubular hinge pin 128 is a tubular roller shaft holder 142. The distance of the holder 142 from the hinge axes varies depending upon the height at which the hinge is installed on the respective door panels. This is in accordance with standard practice where the rails slope inwardly away from the door opening to facilitate slanting of the door sections away from the door jam stops as the doors open. Suitable reinforcement by way of depressions 144 are provided in the outer flanges 126 to strengthen the flanges in carrying the roller shafts in holders 142. Unlike prior art devices, the hinge has fixed locations for the roller pins. The hinges are manufactured to provide for location on the door, fixed roller gradations to accommodate rail slant.

Figure 7:
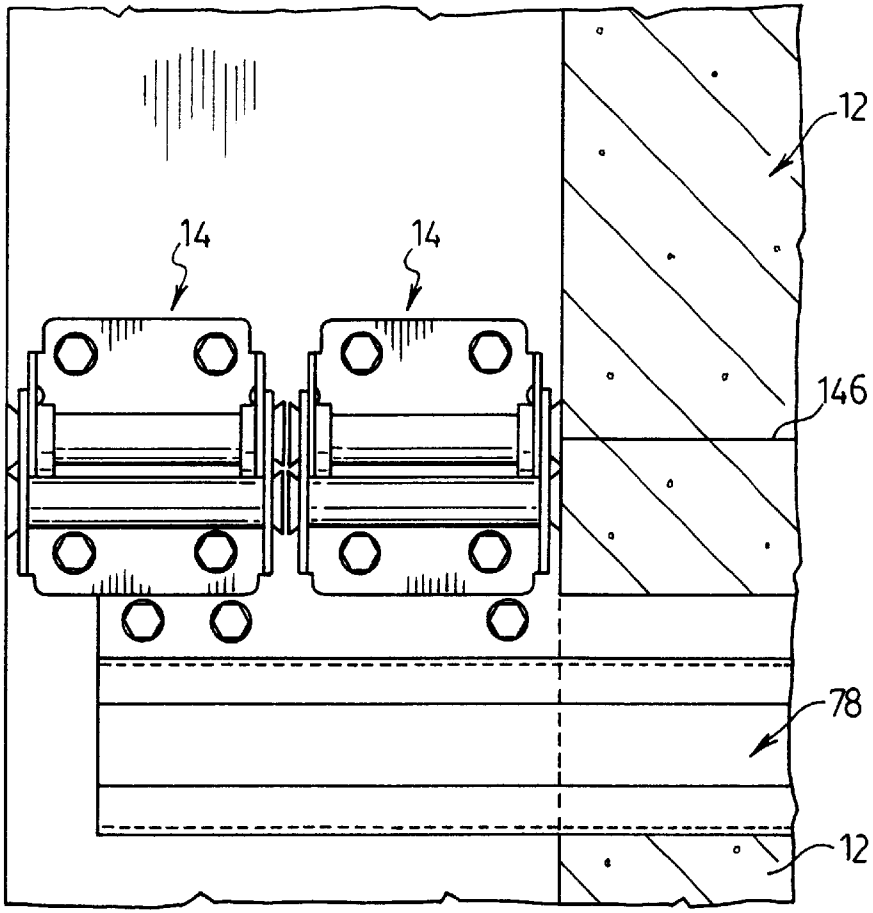
FIG. 7 shows an alternative embodiment of FIG. 6 with two hinges of FIG. 4 mounted in parallel on the door rear surfaces.
Figure 6:
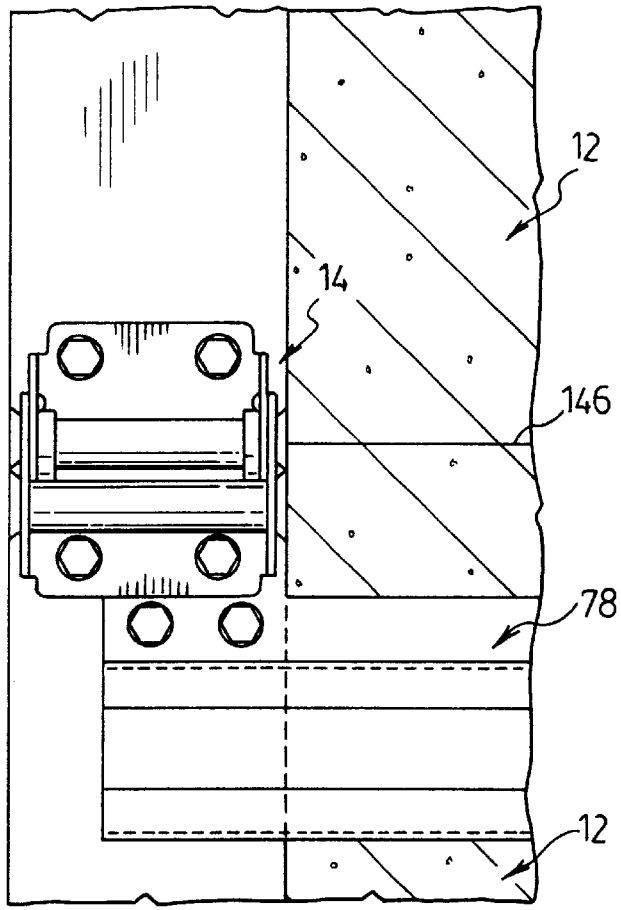
FIG. 6 is a rear elevation view of the door of FIG. 1 with the hinge of FIG. 4 mounted at a joint between two door sections.

With respect to the embodiments of FIGS. 6 and 7, the special hinges 14 are shown in plan. Due to their compact nature they may be mounted above the Z-shaped strut 78 where the hinge axes is aligned with the break 146 between the door sections 12. In the embodiment of FIG. 6, a single hinge is mounted to the door sections. In larger installations where greater load carrying capacity is required, hinges 14 may be mounted adjacent to one another as shown in FIG. 7 where the hinge axes are aligned by the break 146 between the door sections 12.

With the significant benefit of hew reinforcement strut of this invention, door widths may be greatly increased. Usually door widths in excess of 35 feet require custom design for the reinforcement struts. However with this particular strut design, multiples of the struts may be joined together in various ways to significantly increase low carrying capacity of the door system and provide for door widths greatly in excess of 35 feet and even in excess of 45 feet. By use of the strut designs of this invention greater door widths can be accommodated without appreciably increasing Me over all depth of each reinforcement smut so that head room below the retracted door is maximized.

Figure 8:
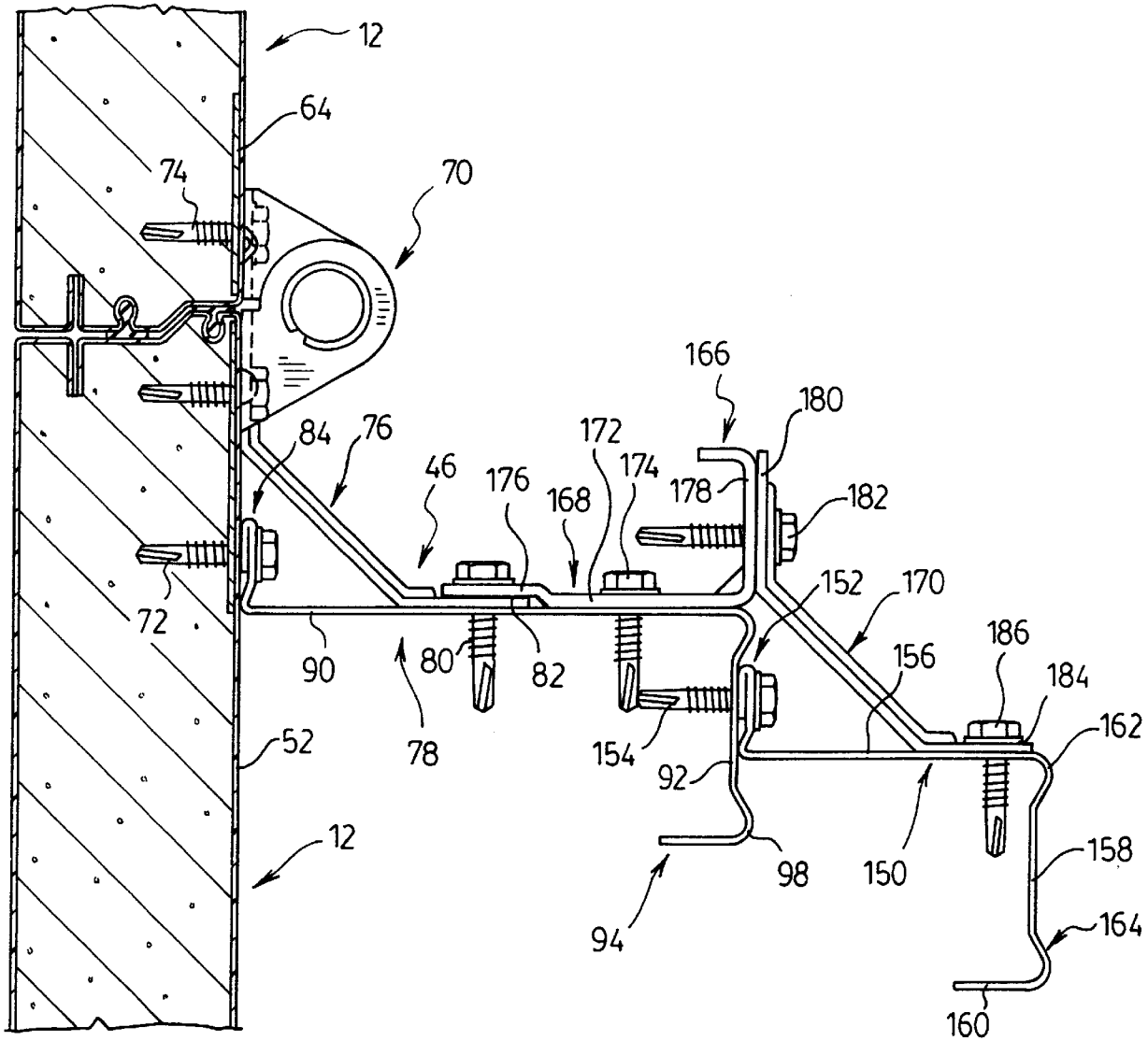
FIG. 8 is a section through an alternative arrangement for a reinforcement strut assembly.
Figure 9:
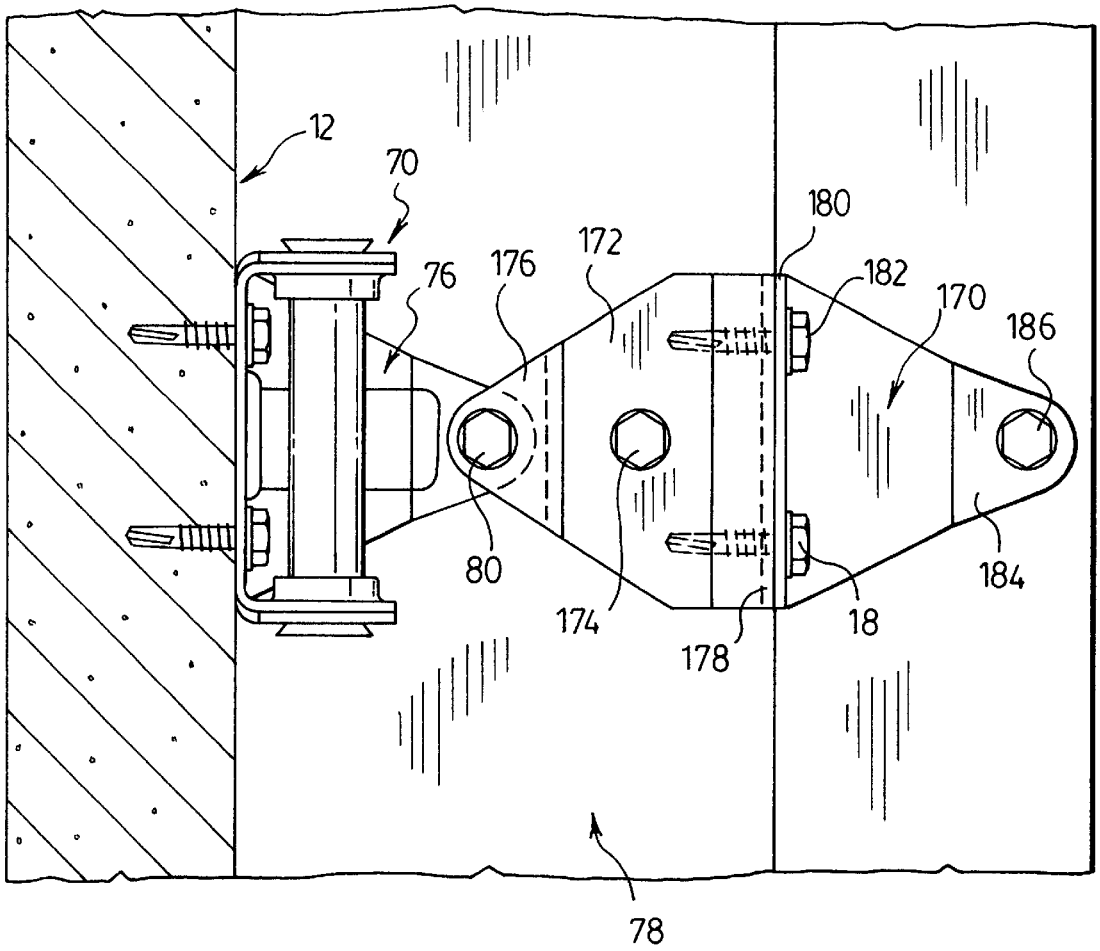
FIG. 9 is a top plan view of the strut assembly of FIG. 8.

With reference to FIG. 8 one embodiment of the invention for the enhanced strut design as shown, the first strut 46 is connected to the door in the normal manner as taught with respect to FIG. 2 including the use of a hinge 70 with integral brace 76. A second strut 150 has its outer flange 152 connected to the rear flange 92 by an appropriate fastener 154. The strut 150 is of the modified Z cross section having the web 156 with depending rear flange 158 and inwardly extending flange 160. The rear flange 158 has the reinforcing beads 162 and 164. Depending upon the loads to be accommodated as dictated by the wind loads and/or door width, the web 156 may be of a particular depth which can be a multiple of the depth of the web 78 of the strut 46. In this particular embodiment the depth of the web 156 is about one half of the depth of the web 78 to thereby increase the overall moment arm of the reinforcing strut from the door inner panel 52 to the depending flange 158. In order to stabilize the addition of the second strut to the first strut a suitable bracket 166 is provided. The bracket 166 includes a first bracket plate 168 and a second bracket plate 170. The first bracket plate has a base 172 which is connected to the web 78 by fastener 174. A recess 176 is formed in the plate to accommodate the thickness of flange 82 of bracket 76 and fastener 80 is used to connect the components together in the manner shown in FIG. 9. Bracket 166 also includes upstanding arm 178 which is connected to a foot portion 180 of bracket 170 by use of fastener 182. Foot portion 184 of bracket 170 is fastened to the web 156 by fastener 186. In accordance with this particular embodiment as shown in FIG. 9, two fasteners 182 are used to interconnect foot 180 to the upright leg 178.

Figure 10:
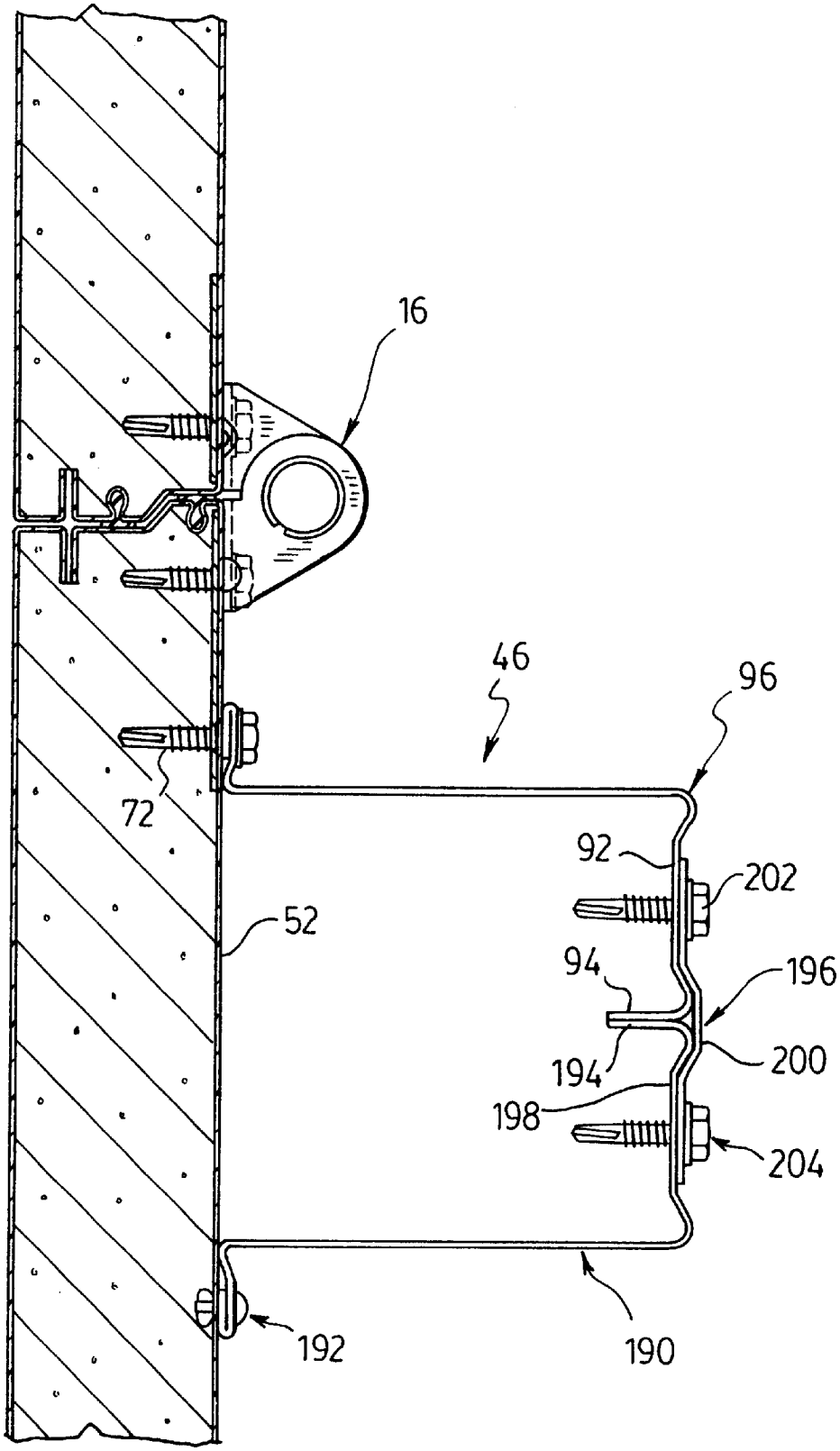
FIG. 10 is a section through a door panel assembly with yet another alternative embodiment for the strut assembly.
Figure 11:
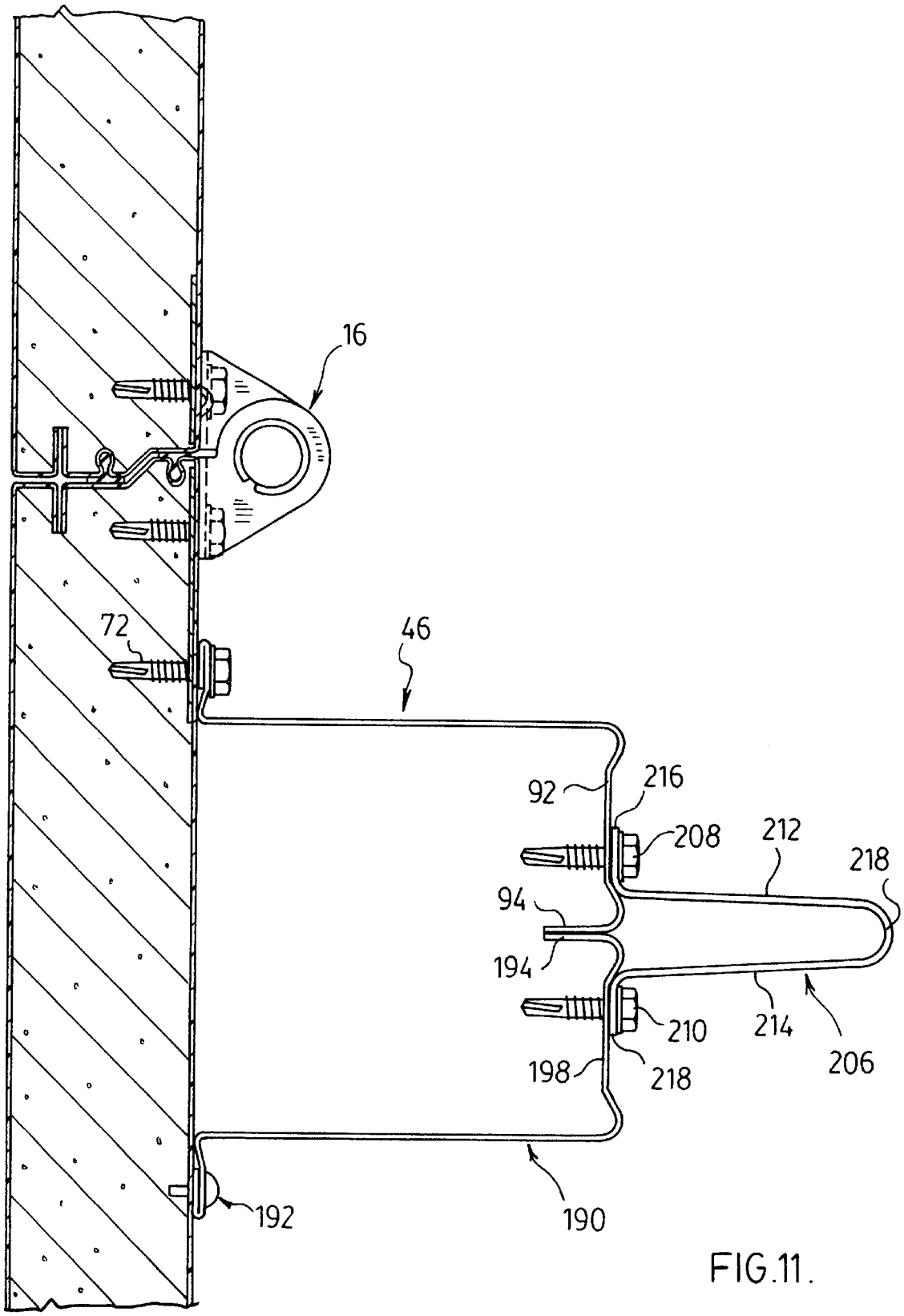
FIG. 11 is a section through the door assembly with yet another alternative embodiment for the strut assembly.

With reference to FIG. 10, yet another alternative embodiment for the modified Z-shaped structural members as shown, the fist structural member 46 is connected to the inner panel 52 of the door by use of the fastener 72. An essentially identical modified Z-shaped strut 190 is also secured to the inner panel 52 of the door by use of a pop rivet or the like 192. The inwardly extended flanges 94 of strut 46 and 194 of strut 190 contact one another. To enhance the strength of this combination a suitable means 196 is provided for maintaining or holding die flanges 94 and 194 in contact. In This particular embodiment a plate 200 is fastened to the respective depending rear flanges 92 and 198 by fasteners 202 and 204. Such a box structure of enlarged modulus section greatly increases the structural integrity of the door hence an installer is able to select suitable struts having the desire web depth to reinforce the door. This avoids custom forming of struts for the door and allows the installer to select form standard items which may be 2 or 3 struts of predetermined web depths. A further alternative to the embodiment of FIG. 10 is shown in FIG. 11 where not only is the section of modulus increased but as well, the moment arm. U shaped brace 206 is fastened to the depending rear flanges 92 and 198 by appropriate fasteners 208 and 210. The U shaped brace 206 has leg portions 212 and 214 with respect of foot portions 216 and 218 which are connected with the fasteners 208 and 210. The U shaped brace 206 maintains contact between the inwardly turned flanges 94 and 194. It is appreciated of course that some separation may occur between the inturned flanges 94 and 194 when the system is over stressed. Due to the flexible arcuate portion 218 of the U shaped brace 206, it is appreciated that this portion of the brace may be formed of spring steel to restrain such separation of flanges 94 and 194. Although for most anticipated wind loads and door widths such slight separation should not compromise the over all structural integrity of the door panel system.

Although preferred embodiments of the invention have been described herein in detail, it will be understood by those skilled in the art that variations may be made thereto without departing from the spirit of the invention of the scope of the appended claims.

What is claimed is:

1. A reinforced garage door panel construction comprising:

i) a sandwich panel system having inner and outer skins with interconnecting insulating material, ii) a continuous reinforcing strip extending along an inner face of said inner skin and secured to said inner face, iii) a modified "Z" shaped structural member extending substantially the length of said panel and secured to said inner skin at said continuous reinforcing strip by fasteners which extend through said skin and into said continuous reinforcing strip, iv) said modified "Z" shaped structural member having a web with an upstanding front flange and a depending rear flange, said upstanding flange is folded onto itself and said fasteners extend through said overlapping portion of said flange, said depending rear flange having an inwardly extending lip extending essentially parallel to said web and said depending flange having spaced apart reinforcing beads extending the length of said depending flange, and wherein a reinforcing brace extends from said inner skin at said continuous reinforcing strip to said web where said brace is fastened to said inner skin and said continuous reinforcement and to said web.

2. A garage door of claim 1 wherein said brace is adapted to be formed integrally with a hinge for interconnecting door panels, said brace adapted to be an extension of a hinge plate and said brace adapted to extend outwardly at an angle towards said web.

3. A garage door of claim 1 wherein said brace comprises a reinforcing bead extending from said structural member to said door panel.

4. A garage door of claim 3 wherein fasteners are adapted to secure a hinge to said door panel inner skin are positioned to each side of said reinforcing bead to thereby locate said fasteners laterally of each other.

5. A garage door of claim 1 wherein a second modified "Z" shaped structural member is secured to the first modified "Z" shaped structural member to increase reinforcing for said door.

6. A garage door of claim 5 wherein said first and second structural members have webs of different depths.

7. A garage door of claim 5 wherein said second structural member is secured to said depending flange of said first structural member and means for restraining flex of said first member along a junction of said web and said rear flange.

8. A garage door of claim 7 wherein said restraining means comprises a plurality of braces, each extending from a top portion of said web of said first structural member to said web of said second structural member.

9. A garage door of claim 5 wherein said second structural member is connected to said door inner face in the inverse orientation of said first structural member whereby said inwardly extending lip of said first and second structural members contact; and means for holding said inwardly extending lips together.

10. A garage door of claim 9 wherein said holding means extends along said depending rear flanges of said first and second members, and is secured to said depending flanges.

11. A garage door of claim 10 wherein said holding means is a "U" shaped brace, the depth of which is selected for increasing a moment arm of said first and second structural members.

* * * * *